United States Patent [19]

Wilborn, II

[11] 4,424,822

[45] Jan. 10, 1984

[54] ROLLER CLIP STRUCTURE

[76] Inventor: Harold A. Wilborn, II, 8442 Mt. Vernon Ct., Wichita, Kans. 67207

[21] Appl. No.: 308,438

[22] Filed: Oct. 5, 1981

[51] Int. Cl.[3] ..... A45D 8/00

[52] U.S. Cl. ..... 132/46 A; 132/40; 132/1 R

[58] Field of Search ..... 132/46, 48, 40; 24/255 BS, 255 R, 259 R, 257 R; 128/346, 321, 325, 354; D8/394, 395, 396

[56] References Cited

U.S. PATENT DOCUMENTS

| | | | |
|---|---|---|---|
| 766,870 | 8/1904 | Briney | 132/46 A |
| 2,795,834 | 6/1957 | Szoke | 24/257 R |
| 3,335,734 | 8/1967 | Kackloudis | 132/46 R |
| 3,358,698 | 12/1967 | Blanchard | 132/46 R |

*Primary Examiner*—C. Fred Rosenbaum
*Assistant Examiner*—Sherri Vinyard
*Attorney, Agent, or Firm*—Phillip A. Rein

[57] ABSTRACT

This invention is a roller clip structure constructed of a biased flexible material operable to position and hold a heat roller member against a person's head. More particularly, the roller clip structure includes an actuator head member integral with a main body assembly which, in turn, is integral with a stabilizer assembly. The actuator head member includes a central connector member integral with first and second actuator arms. A person uses its thumb and forefinger to move the spring biased first and second actuator arms toward each other to open the main body assembly to place same about a heat roller member. The main body assembly includes first and second leg members adapted to clamp the heat roller member and a portion of a person's hair therebetween while achieving a maximum of heat transfer. The stabilizer assembly includes first and second foot members integral with respective ones of first and second leg members. Each of the first and second foot members includes a support portion being in a common plane which is perpendicular to a vertical, longitudinal plane of the entire roller clip structure. The support portions, in the mounted position, abutts a person's head for proper positioning and stability.

5 Claims, 5 Drawing Figures

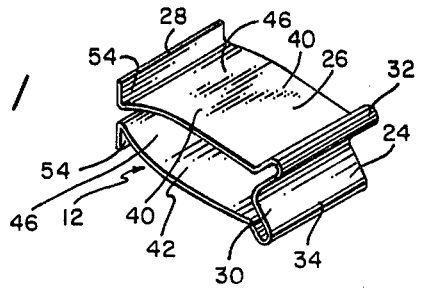
FIG. 1
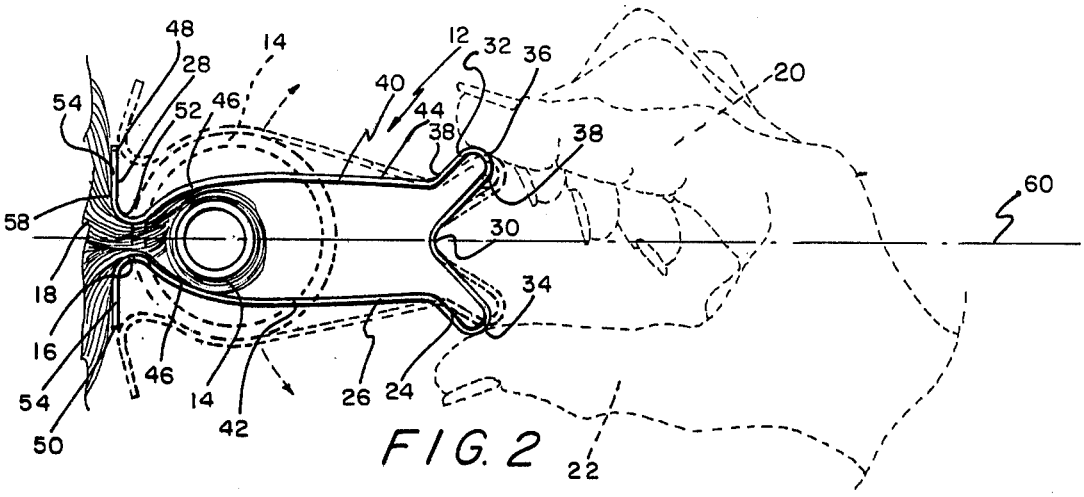
FIG. 2
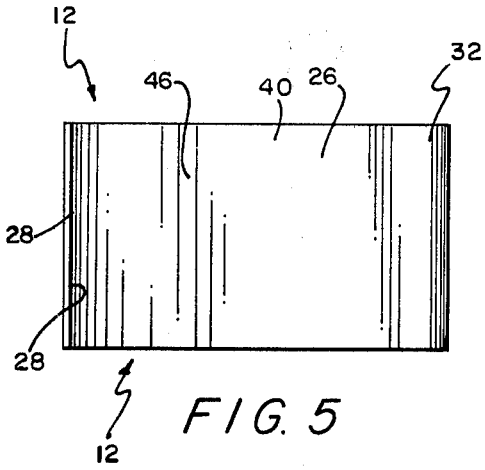
FIG. 5
FIG. 3
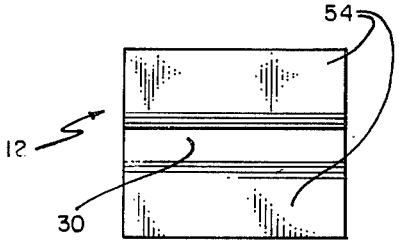
FIG. 4
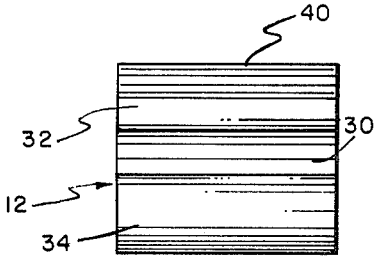

ROLLER CLIP STRUCTURE

PRIOR ART

A search of the prior art revealed the following U.S. Pat. Nos.: 3,279,449; 3,587,595.

The U.S. Pat. No. 3,279,449 discloses a clip spring wire catapult structure but differs substantially in appearance and usage from our invention claimed herein.

The U.S. Pat. No. 3,587,595 is pertinent in teaching the use of a wire clip to hold a heat roller member in place on a person's head. However, the clip in the reference (1) differs substantially in appearance; (2) contacts a minimum amount of a person's hair and the heat roller member; (3) is not attached and removed from the heat roller member in a manner similar to our invention; and (4) does not position the heat roller member in a definite spaced relationship to the person's head to which it is attached.

PREFERRED EMBODIMENT OF THE INVENTION

In one preferred embodiment of the invention, a roller clip structure is used to connect a hair roller such as a heat roller member to a person's hair and against a portion of the subject person's head. The roller clip structure is preferably constructed of a flexible sheet material such as spring steel or a plastic material and having a length substantially equal to that of the heat roller member to achieve a maximum holding power plus heat transfer characteristics. The roller chip structure includes an actuator head member; a main body assembly connected to the actuator head member; and a stabilizer assembly. The actuator head member includes a central connector member connected integrally on opposite sides to respective ones of the first and second actuator arms. The main body assembly includes first and second leg members integrally connected to respective ones of the first and second actuator arms. Then, the stabilizer assembly includes first and second foot members integrally connected to respective outer ends of the first and second leg members. The actuator head member acts to bias the first and second leg members toward each other to clamp a person's hair therebetween about a heat roller member. The actuator arms are moved toward each other to spread open the first and second leg members. Also, the first and second leg members are flexible to conform in shape to the outer contour of various sizes of the heat roller members. Each of the the first and second foot members a support portion adapted to be pressed against a person's hair and adjacent head portion to position and hold a heat roller member in the desired spaced relationship.

OBJECTS OF THE INVENTION

One object of this invention is to provide a roller clip structure usable with existing and various sizes of hair roller structures to achieve a much better clamping action.

One other object of this invention is to provide a roller clip structure that provides a large contact area to hold a portion of a person's hair between same and a hair roller structure for increased heat transfer and resultant efficient hair styling.

Still, another object of this invention is to provide a roller clip structure that is easy to attach to and remove from a hair roller structure while positioning same in the right location.

A further object of this invention is to provide a roller clip structure having a stabilizer assembly operable to firmly place the hair clip structure in the proper position and spacing from a person's scalp.

Still, one further object of this invention is to provide a roller clip structure that is easy to use, economical to manufacture, and maintenance free.

Various other objects, advantages, and features of the invention will become apparent to those skilled in the art from the following discussion, taken in conjunction with the accompanying drawings, in which:

FIGURES OF THE INVENTION

FIG. 1 is a perspective view of a roller clip structure of this invention;

FIG. 2 is a side elevational view of the roller slip structure of this invention showing in dotted lines how the invention is operated by a person's fingers to place same about a heat roller member and held against a person's head portion;

FIG. 3 is an elevational plan view of one end of the roller clip structure of this invention;

FIG. 4 is an elevational plan view of the opposite end of the roller clip structure of this invention; and FIG. 5 is a top plan view of the roller clip structure of this invention.

The following is a discussion and description of preferred specific embodiments of the roller clip structure of this invention, such being made with reference to the drawings, whereupon the same reference numerals are used to indicate the same or similar parts and/or structure. It is to be understood that such dicussion and description is not to unduly limit the scope of the invention.

DESCRIPTION OF THE INVENTION

Referring to the drawings in detail, a roller clip structure of this invention, indicated generally at 12, is shown in FIG. 2 as being attached to a heat roller member 14 having a portion of a person's hair 16 clamped therebetween and against a person's scalp 18 under the adjacent hair 16. It is noted that a person's thumb 20 and forefinger 22 are used to open and close the roller clip structure 12 in a manner to be explained. Also, it is noted that the heat roller member 14 can be of varying diameters and still function properly with the roller clip structure 12.

The roller clip structure 12 is preferably constructed of a flexible sheet material such as spring steel, plastics, etc. so that a built-in biasing or clamping action is achieved. The roller clip structure 12 is of a width substantially equal to the length of the heat roller member 14 for reasons to be explained.

The roller clip structure 12 includes (1) an actuator head member 24; (2) a main body assembly 26 connected to the actuator head member 24; and (3) a stabilizer assembly 28 connected to the main body assembly 26.

The actuator head member 24 is of a generally V-shape having a central connector member 30 with outwardly extended first and second actuator arms 32, 34 integrally connected thereto. The central connector member 30 is also of V-shape and acts similar to a leaf spring to bias the first and second actuator arms 32, 34 outwardly as will be explained.

Each of the first and second actuator arms 32, 34, are of U-shape in transverse cross section having a semi-circular mid-section 36 integral with spaced, parallel sidewalls 38.

The main body assembly 26 includes a first leg member 40 and a second leg member 42 secured to respective outer sidewalls 38 of the first and second actuator arms 32, 34. As the first and second leg members 40, 42 are substantially identical, only one need be described in detail.

The first leg member 40 includes a main body section 44 integral at one end with the adjacent sidewall 38 of the first actuator arm 32. The main body section 44 is formed with an arcuate connection section 46 to clamp about an outer surface of the heat roller member 14 in a manner to be explained.

As noted in FIG. 2, the stabilizer assembly 28 includes a first foot member 48 and second foot member 50 integral with a respective one of the first and second leg members 40, 42. Each of the first and second foot members 48, 50 includes a connector portion 52 integral with a support portion 54.

The connector portions 52 are of an arcuate shape adapted to almost abutt each other in the non-use condition and allow a portion of a person's hair to be extended therebetween in the usage condition as shown in FIG. 2.

The support portions 54 extend in opposite directions but in a common plane to form a support surface 58 which performs an important function as will be explained. Also, in the non-use condition, the support portions 54 lie in a common plane that is perpendicular to a vertical longitudinally extended plane, indicated at 60, of the entire roller clip structure 12.

It is noted that the roller clip structure 12 of this invention can be made of various materials and sizes to accomodate heat roller members 14 of varying diameters. The roller clip structure 12 illustrated in the drawing is designed ideally for a one (1) inch diameter heat roller member 14 but can also be effectively used for one-half ($\frac{1}{2}$) to one and one-half ($1\frac{1}{2}$) inch diameter hair roller structures.

Ideally for a one (1) inch diameter heat roller member 14, the arcuate connection section 46 of the first and second leg members 40, 42 is formed with a one (1) inch radius with the pivot point thereof positioned one (1) inch up from the support surface 58 of the support portions 54. This achieves the maximum clamping action and heat transfer between the roller clip structure 12 and the heat roller member 14.

USE AND OPERATION OF THE INVENTION

As noted in FIG. 1, the actuator head member 24 of the roller clip structure 12 can be grasped by a person's thumb 20 and forefinger 22 to move the first and second actuator arms 32, 34 toward each other. As noted in dotted lines, it is obvious that this pinching action caused the first and second leg members 40, 42 to move in opposite directions for ease of attaching or removing the roller clip structure 12 from the heat roller member 14.

The first step in the hair styling operation is to heat the roller members 14 in a conventional known manner. Then, a portion of a person's hair 16 is wrapped about the heat roller member 14 as shown on the smaller one in solid lines in FIG. 2.

A roller clip structure 12 is then grasped by the person's thumb 20 and forefinger 22 and placed about the heat roller member 14 as shown in FIG. 2. As can be seen, the arcuate connector section 46 clamps firmly about the outer contour of the heat roller member 14 and the support surface 58 is pressed against the person's hair 16 between the heat roller member 14 and the person's scalp 18.

The stabilizer assembly 28 achieves positive positioning of the heat roller member 14 space wise from the person's scalp 18 plus holds the roller clip structure 12 substantially erect and perpendicular to the person's head portion.

Furthermore, the large area of the roller clip structure 12, achieves better clamping of the person's hair 16 between same and the heat roller member 14 plus substantial heat transfer area to aid in the hair styling.

A large heat roller member 14 used with the roller clip structure 12 is shown in dotted lines in FIG. 2. It is seen that very satisfactory contact is made between the first and second leg members 40, 42, the person's hair 16, and the heat roller member 14 which illustrates comparison between a one-half ($\frac{1}{2}$) inch roller and one (1) inch roller.

It is seen that the roller clip structure of this invention is easy to use, economical to manufacture, efficient in operation, and maintenance free.

While the invention has been described in conjunction with preferred specific embodiments thereof, it will be understood that this description is intended to illustrate and not to limit the scope of this invention, which is defined by the following claims.

I claim:

1. A roller clip structure adapted to hold a cylindrical roller member against a person's hair; comprising:

(a) an actuator head member;

(b) a main body assembly having first and second leg members connected to said actuator head member;

(c) said first and second leg members each having a main body section integral with an arcuate connector section;

(d) a stabilizer assembly connected to said first and second leg members;

(e) said stabilizer assembly having first and second foot members, each having a support portion extended in opposite directions in a common plane adapted to compress a portion of a person's hair against the person's scalp;

(f) said main body sections extended in spaced, parallel planes; and whereby said actuator head member is operable to spread apart said first and second leg members for clamping the roller member between said arcuate connector sections.

2. A roller clip structure as described in claim 1, wherein:

(a) said actuator head member having a central connector member integral with first and second actuator arms forming said actuator head member of generally V-shape;

(b) said central connector member of V-shape in transverse cross section;

(c) said first and second actuator arms of U-shape in transverse cross section; and (d) said central connector member biases said first and second actuator arms outwardly whereby movement of said first and second actuator means toward each other separate said first and second leg members for releasing or attaching a roller member thereto.

3. A roller clip structure as described in claim 1, wherein:

(a) said main body sections of a length substantially greater than the distance between spaced ones of said main body sections so as to receive, accomodate, and enclose roller members of varying diameters.

4. A roller clip structure as described in claim 1, wherein:

(a) the radius of curvature of said arcuate connector sections of said first and second leg sections from a common point and a distance from a support surface of said support portions to said common point is equal to the diameter of the roller member clamped by said first and second leg members for maximum efficiency.

5. A roller clip structure adapted to hold a cylindrical roller member against a person's hair; comprising:

(a) an actuator head member;

(b) a main body assembly having first and second leg members connected to said actuator head member;

(c) said first and second leg members each having a main body section integral with an arcuate connector section;

(d) a stabilizer assembly connected to said first and second leg members;

(e) said stabilizer assembly having first and second foot members extending in opposite directions in a common plane, each having a support portion adapted to compress a portion of a person's hair against the person's scalp;

(f) said main body sections extended in spaced, parallel planes; and whereby said actuator head member is operable to spread apart said first and second leg members for clamping the roller member between said arcuate connector sections;

(g) said first and second foot members each having an arcuate connector portion connected between respective ones of said first and second leg members and said support portions; and (h) said support portions extended in the common plane which is generally perpendicular to the spaced, parallel planes of said main body sections for support and stability purposes.

* * * * *